US006538664B2

(12) United States Patent
Fisekovic et al.

(10) Patent No.: US 6,538,664 B2
(45) Date of Patent: Mar. 25, 2003

(54) MATRIX DISPLAY DEVICE WITH IMPROVED IMAGE SHARPNESS

(75) Inventors: Nebojsa Fisekovic, Eindhoven (NL); Tore Nauta, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 162 days.

(21) Appl. No.: 09/828,011

(22) Filed: Apr. 6, 2001

(65) Prior Publication Data

US 2001/0038374 A1 Nov. 8, 2001

(30) Foreign Application Priority Data

Apr. 19, 2000 (EP) ..... 00201409

(51) Int. Cl.[7] ..... G09G 5/10

(52) U.S. Cl. ..... 345/690; 345/204; 345/89; 345/98; 345/100

(58) Field of Search ..... 345/204, 89, 98, 345/100, 690

(56) References Cited

U.S. PATENT DOCUMENTS 5,850,216 A * 12/1998 Kwon ..... 345/204
6,476,824 B1 * 11/2002 Suzuki et al. ..... 345/690

* cited by examiner

*Primary Examiner*—Matthew C. Bella
*Assistant Examiner*—Tam Tran

(57) ABSTRACT

Matrix display devices are addressed, using a multiple line addressing method. In such a method, two or more paired lines are addressed at the same time and receive the same luminance value data. A method is provided where the line multiplet is shifted by a number of lines (preferably one) for two successive subframes, and where the average of the values over the subframes is equal to the original luminance value data.

Further improvements of the method comprise clipping of out-of-range values, and flicker reduction by limiting the differences between the luminance values for two successive frames.

12 Claims, 2 Drawing Sheets

MATRIX DISPLAY DEVICE WITH IMPROVED IMAGE SHARPNESS

FIELD OF THE INVENTION

The invention relates to a matrix display device comprising a receiving circuit for receiving successive frames, each frame comprising a set of original line luminance values $D_1, \ldots D_M$ of pixels $d_{11}, \ldots d_{1N}, \ldots d_{M1} \ldots d_{MN}$, the matrix display device further comprising a display panel comprising a set of display lines $r_1 \ldots r_M$, and a driver circuit for supplying line luminance values to said display lines.

The invention also relates to a method of displaying successive frames, each frame comprising a set of original line luminance values $D_1, \ldots D_M$ of pixels $d_{11}, \ldots d_{1N}, \ldots d_{M1} \ldots d_{MN}$, on a display panel comprising a set of display lines $r_1, r_2 \ldots r_N$, extending in a first direction and a set of data lines intersecting the set of display lines, each intersection defining a pixel.

The invention is applicable, inter alia, in plasma display panels (PDPs), plasma-addressed liquid crystal panels (PALCs), liquid crystal displays (LCDs), which may be used for personal computers, television sets, etc.

BACKGROUND OF THE INVENTION

As shown in FIG. 1, a matrix display panel comprises a first set of data lines (rows) $r_1 \ldots r_M$ extending in a first direction, usually called the row direction, and a second set of data lines (columns) $c_1 \ldots c_N$ extending in a second direction, usually called the column direction, intersecting the first set of data lines, each intersection defining a pixel (dot) $d_{11} \ldots d_{NM}$.

The matrix display furthermore comprises a receiving circuit 2 for receiving an information signal D comprising information on the luminance of lines to be displayed and means for addressing the first set of data lines (rows $r_1, \ldots r_M$) in dependence on the information signal.

Such a display panel may display a frame by addressing the first set of data lines (rows) line by line, each line (row) successively receiving the appropriate data to be displayed.

In order to reduce the time necessary for displaying a frame, the double line addressing method may be applied. In this method, two neighboring lines of the first set of data lines (rows) are simultaneously addressed, receiving the same data. When two successive frames are considered, the pairs of lines in the second frame are shifted one line compared to the first frame.

This so-called double line (or, in general, multiple line) addressing method effectively allows speed-up of the display of a frame, because each frame requires less data, but at the expense of a loss of quality with respect to the original signal because each pair of lines receives the same data, which induces a loss of resolution and/or of sharpness due to the duplication of the lines.

Due to the ability of the human eye to merge signals which are displayed quickly after each other, when the double line addressing system is applied, the viewer cannot see the odd and even frames separately due to the quick frame change. But he can see the average value of these two frames. The average brightness of the image displayed may not correspond to that of the original image, thus resulting in a loss of resolution and/or sharpness.

SUMMARY OF THE INVENTION

It is an object of the invention to provide a method of addressing a matrix display panel with double line addressing where loss of resolution and/or sharpness with respect to the image obtained by single line addressing is reduced, and preferably minimized.

To this end, a first aspect of the invention provides a matrix display device as claimed in claim 1. A second aspect of the invention provides a method as claimed in claim 7. Advantageous embodiments are defined in the dependent claims.

In a display device in accordance with the invention, the average brightness is close to the brightness of the original image, as will be explained below.

According to the invention, a device using double line addressing comprises a computing unit for computing new line luminance values $C_0, \ldots C_M$ of pixels $c_{11}, \ldots c_{1N}, \ldots c_{M1} \ldots c_{MN}$ as follows:

- a first line luminance value $C_0$ is initialized, for every other one of the line luminance values $C_n$, the line luminance value $C_n$ is equal to twice the original line luminance value $D_n$ for the nth line minus the line luminance value for the previous line $C_{n-1}$ ($C_n = 2D_n - C_{n-1}$),
- the driver circuit comprises means for supplying the line luminance values $C_0, \ldots C_M$ to said display lines $r_1 \ldots r_M$ in two successive subframes,
- odd line luminance values $C_1, C_3, \ldots C_{2n+1}, \ldots$ being supplied to pairs of adjacent display lines $(r_1,r_2)$, $(r_3,r_4), \ldots (r_{2n+1},r_{2n+2}), \ldots$ respectively, during one of said two successive subframes,
- the line luminance value $C_0$ and even line luminance values $C_2, C_4, \ldots C_{2n}, \ldots$ being supplied to the first display line $r_1$ and to pairs of adjacent display lines $(r_2,r_3), (r_4,r_5), \ldots (r_{2n},r_{2n+1}), \ldots$ respectively, during the other of said two successive subframes.

Further improvements are described below and are the subject of the dependent claims.

These and other aspects of the invention are apparent from and will be elucidated with reference to the embodiment(s) described hereinafter with reference to the accompanying drawings.

DETAILED DESCRIPTION OF THE PREFERRED EMBODIMENT

Figure 1:
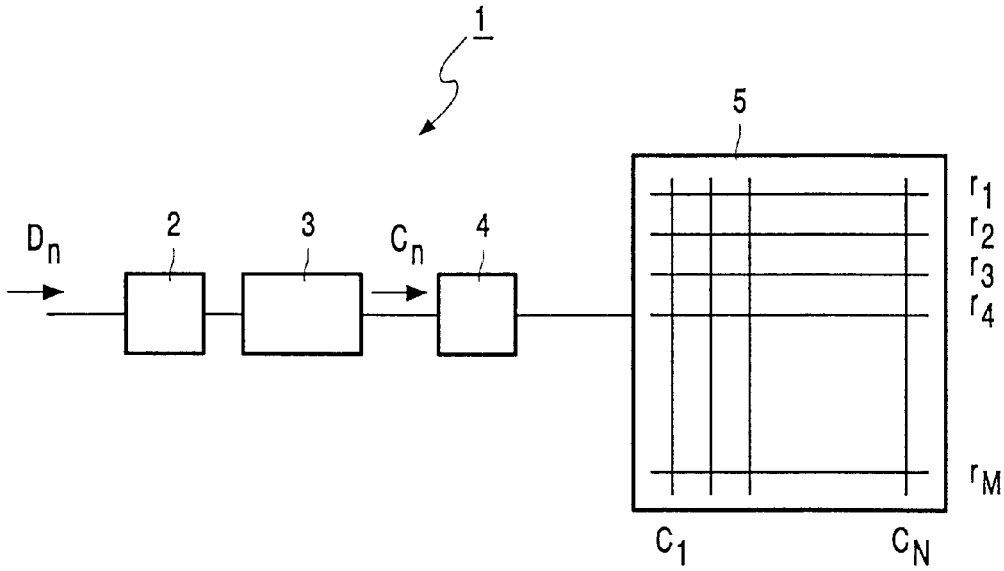
FIG. 1 schematically shows a matrix display panel.

FIG. 1 is a schematic diagram of a device comprising a matrix display panel 5, showing a set of display lines (rows) $r_1, r_2, \ldots r_m$. The matrix display panel 5 comprises a set of data lines (columns) $c_1 \ldots c_N$ extending in a second direction, usually called the column direction, intersecting the first set of data lines, each intersection defining a pixel (dot) $d_{11} \ldots d_{NM}$. The number of rows and columns need not be the same.

The matrix display furthermore comprises a circuit 2 for receiving an information signal D comprising information on the luminance of lines to be displayed, and a driver circuit 4 for addressing the set of data lines (rows $r_1, \ldots r_M$) in dependence on the information signal D, which signal comprises original line luminance values $D_1, \ldots D_M$. The display device in accordance with the invention comprises a computing unit (3) for computing new line luminance values $C_{1-(m-1)}, \ldots C_0, \ldots C_M$ of pixels $d_{11}, \ldots d_{NM}$ on the basis of original line luminance values $D_1, D_2, \ldots D_m$.

For the rest of the description, the line luminance values of each pixel are normalized so as to be between 0 and 1, 1 representing a maximum value.

Figure 2:
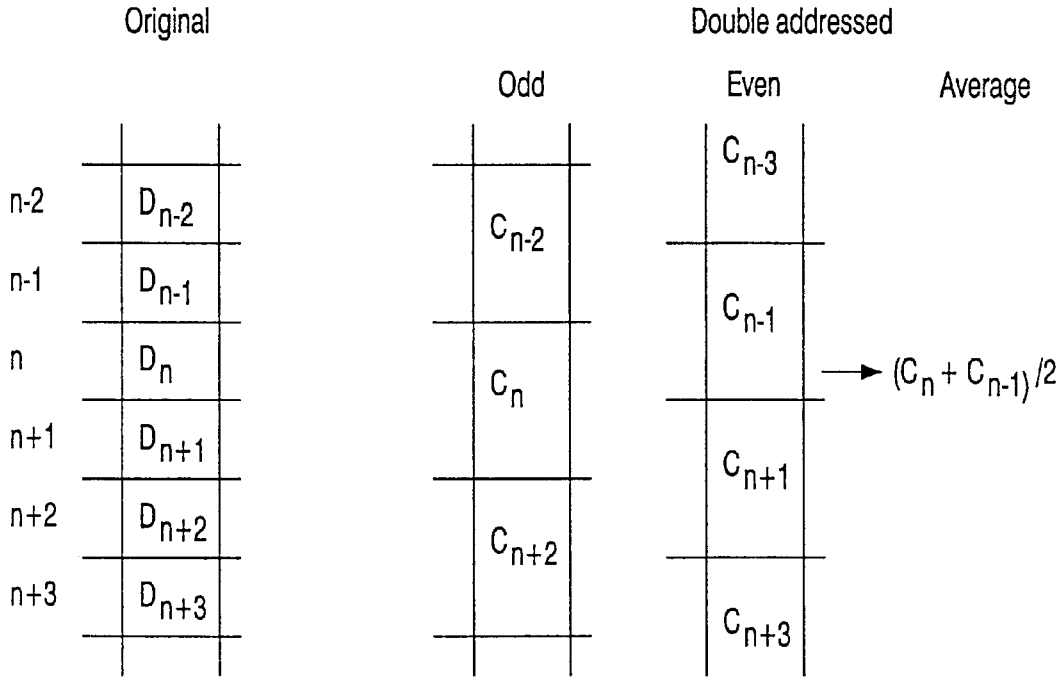
FIG. 2 schematically illustrates a double line addressing method in accordance with the invention.

FIG. 2 schematically illustrates a double line addressing method in accordance with the invention. In this explanation, only one column of the columns $c_i$ is taken into account. For each column, there is a set of luminance values $D_i$. So it would be more accurate to discuss the invention using luminance values $D_{ii}$, i.e. having a double index indicating the row and the line. However, although the values $D_{ii}$ may be different for each column, the same operations are performed for each column and, for that reason, a luminance value D with only a line index i i.e. $D_i$ (or, see below, for computed values $C_i$) is denoted. $D_i$ represents in effect a set of data ($D_{1i}$, $D_{2i}$, $D_{3i}$, etc). It is to be noted that the luminance values are to be broadly considered as input data corresponding to or determining the luminance of a pixel. In the simplest approach, the luminance value $D_n$ is directly proportional to the luminance of the pixel, but in more sophisticated approaches, the luminance value may be some value which has a one-to-one relationship with the luminance of the pixel.

As shown in FIG. 2, the line luminance value for each line $r_{n-2}, \ldots r_{n+3}$ of the original luminance signal is $D_{n-2} \ldots D_{n+3}$, respectively, the index for D indicates the corresponding line number, and for the C-values the index indicates the first of the set of lines.

The computed line luminance values for double line addressed lines $(r_{n-1},r_n),(r_{n+1},r_{n+2})$ are denoted $C_{n-1},C_{n+1}$ respectively. Each of these values is displayed on the corresponding pair on lines during a succeeding even frame.

The line luminance value for each line $r_{n-1}, \ldots r_{n+3}$ of the original signal is $D_{n-1}, \ldots D_{n+3}$, respectively. The computed line luminance values for double line addressed lines $(r_{n-2}, r_{n-1}), \ldots (r_{n+2}, r_{n+3})$ are denoted $C_{n-2}, \ldots C_{n+2}$ respectively. Each of these values is displayed on the corresponding pair on lines during an odd frame.

If the succeeding frames are displayed fast enough after each other, the observer views the average luminance levels. Therefore, the average of the double addressed computed luminance values $C_n,C_{n-1}$ for line n should equal the luminance value of the original signal $D_n$. For row n, this is given by $$\frac{C_n + C_{n-1}}{2} = D_n \tag{1}$$

This results in a recursive relation for $C_n$ $$C_n=2D_n-C_{n-1} \tag{2}$$

which is the subject matter of device claim 2 and method claim 8.

More in general, for m-multiplets for row n it holds $$\frac{C_n + C_{n-1} + C_{n-2} \ldots + C_{n-(m-i)}}{m} = D_n$$

which results in $$C_n=mD_n-(C_{n-1}+C_{n-2}+ \ldots +C_{n-(m-1)}) \tag{3a}$$

which is the subject of device claim 1 and method claim 7.

For double line addressing to calculate the luminance value $C_n$ for line $r_n$, the original luminance value $D_n$ is needed together with the calculated value $C_{n-1}$ of the previous line $r_{n-1}$. For a starting line, e.g. at the top of the image (line $r_1$), a starting value is needed: i.e. $C_0$. It appears that this is not a very important parameter, which does not have much impact on the rest of the calculations. It is preferred, however, to make this value $D_1$, because then $C_1$ also becomes equal to $D_1$.

$$C_0=D_1 \tag{4}$$

and $C_1=2D_1-C_0=D_1$

For multiple (m-multiplets) line addressing to calculate the luminance value $C_n$ for line $r_n$, the original luminance value $D_n$ is needed together with the calculated values $C_{n-1}$ etc. of the previous lines $r_{n-1}, r_{n-2}, \ldots r_{n-(m-1)}$. For a number of starting lines, e.g. at the top of the image, m−1 starting values enumerated $C_{1-(m-1)}$ to $C_0$ are needed. It appears that these are not very important parameters, which do not have much impact on the rest of the calculations. They influence only the m−1 top lines of the image. It is preferred, however, to make these values $D_1$, because then $C_1$ also becomes equal to $D_1$.

$$C_1=mD_1-(C_0+C_{-1}+C_{-2}+(C_{1-(m-1)})=mD_1-(m-1)D_1=D_1$$

When the computed values are taken in accordance with relation (2) or (2a), the average will always be the same as the original signal. In other words, the original picture image intensity will be obtained. Thus, the object of the invention is obtained in a relatively simple manner.

In further embodiments of the invention, more refined algorithms are implemented to reduce some problems which may arise and require more attention.

In general, relations (2) or (2a) may not be satisfied for every pixel (dot). In some cases, the calculated value $C_n$ could be out of range, i.e. it becomes higher than 1 (which stands for a maximum value), or less than 0. These cases are preferably treated by clipping the out-of-range values to maximum or minimum. In a pseudo-code, the clipping algorithm is described as $$\text{if } (C_n<0)\ \{C_n=0;\} \tag{5}$$

$$\text{if } (C_n>1)\ \{C_n=1;\} \tag{6}$$

which is the subject matter of claim 3 and claim 9. It is noted that, as stated before, the same operation is performed for all columns. As stated above, $C_n$ actually stands for a set of data, and, although the same clipping algorithm is used for each column, the outcome could thus be different per column. If, for one of the columns, the line luminance value is clipped to zero, then this holds for that one column and does not mean that the luminance value would be clipped to zero throughout the line.

At a certain refresh rate, flicker may become visible when the pixel values of two successive frames differ too much from each other, i.e. when $C_n$ and $C_{n-1}$ are very far apart. To control this effect, a rule that limits the allowed difference between the C values is introduced in preferred embodiments of the invention. When the difference between $C_n$ and $C_{n-1}$ is larger then a certain threshold Fth, $C_n$ is altered in such a way that the difference becomes equal to that thresh old. In the implementation of this rule, one has to keep in mind that $C_n$ may be both bigger and smaller than $C_{n-1}$.

$$\text{if } (C_n - C_{n-1} > Fth)\{\Delta = C_n - C_{n-1} - Fth;\ C_n = C_n - \Delta;\} \quad (7)$$
$$\text{if } (C_n - C_{n-1} < -Fth)\{\Delta = C_{n-1} - C_n - Fth;\ C_n = C_n + \Delta;\}$$

The parameter Fth defines the maximum difference between the luminance values of a pixel in two successive frames. A large value of Fth gives more flicker, but a better sharpness. A small value of Fth gives less flicker, but a loss of sharpness. The inventors have observed that good results are obtained by adjusting the values of the parameters Fth in a range of 0.2 to 0.5. In the case of a PALC display, a value of substantially 0.35 gave the best results.

By applying this rule, flicker will be reduced, but, as the inventors have realized, the image sharpness could be affected as well. For certain image data (e.g. large transitions), the Δ in (6) can become so high that the error in the final image becomes too big. Making Δ smaller to avoid this big error would lead to a difference between Cn and Cn−1 that is larger than Fth, which results in more flicker. However, because this special situation occurs only in very small areas, this flicker will actually not be visible. Therefore, in preferred embodiments of the invention, a new threshold called Dth is introduced, which limits the Δ in relation (6).

$$\text{if } (\Delta > Dth)\{\Delta = Dth;\} \quad (8)$$

The parameter Dth defines the maximum difference between optimum C value and the applied value. A large value of Dth gives less flicker, but errors on big transitions (e.g. white to black edge). A small value of Dth gives better edges, but more flicker. The inventors have observed that good results are obtained by adjusting the values of the parameters Dth in a range of 0.2 to 0.5. In the case of a PALC display, a value of 0.3 gave the best results.

Flicker is most visible in large uniformly colored areas. This flicker can be reduced by using the right Fth value (small enough), which, however, will lead to large errors (reduction of sharpness) in the non-uniform areas. By introducing an additional rule for special flicker reduction, this trade-off can be prevented.

Equations (2) and (2a) show that the difference between $C_n$ and $D_n$ on top of a uniform area will be preserved through the rest of the uniform area. In other words, the starting C-D difference defines the difference for the whole area. Therefore, the idea is to make $C_n$ equal to $D_n$ at the top edge of each uniform area. The best result is achieved by doing this gradually, i.e. by decreasing the C-D difference in every row with a certain parameter called Sth. If the difference between $C_n$ and $D_n$ is already less than Sth, $C_n$ is made equal to $D_n$.

$$\text{if } (|C_n - D_n| < Sth)\{C_n = D_n;\} \quad (9)$$
$$\text{if } (C_n > D_n)\{C_n = C_n - Sth;\}$$
$$\text{if } (C_n < D_n)\{C_n = C_n + Sth;\}$$

Some kind of uniformity check would be needed in order to apply this rule on top of each uniformly colored area. However, experiments proved that it was not necessary to perform such a check. Applying rule (8) on every pixel instead of applying it only to uniformly colored areas does not show noticeable differences in image quality.

Parameter Sth is introduced to decrease the difference between pixel values of the two successive frames. If a column contains a part with all the same values, the difference between the pixel values of the two successive frames will go to zero. A large value of Sth gives less flicker, but a loss of sharpness. A smaller value of Sth gives a better sharpness, but more flicker. The inventors have observed that good results are obtained by adjusting the values of the parameter Sth in a range of 0.02 to 0.05. In the case of a PALC display, a value of substantially 0.04 gave the best results.

Figure 3:
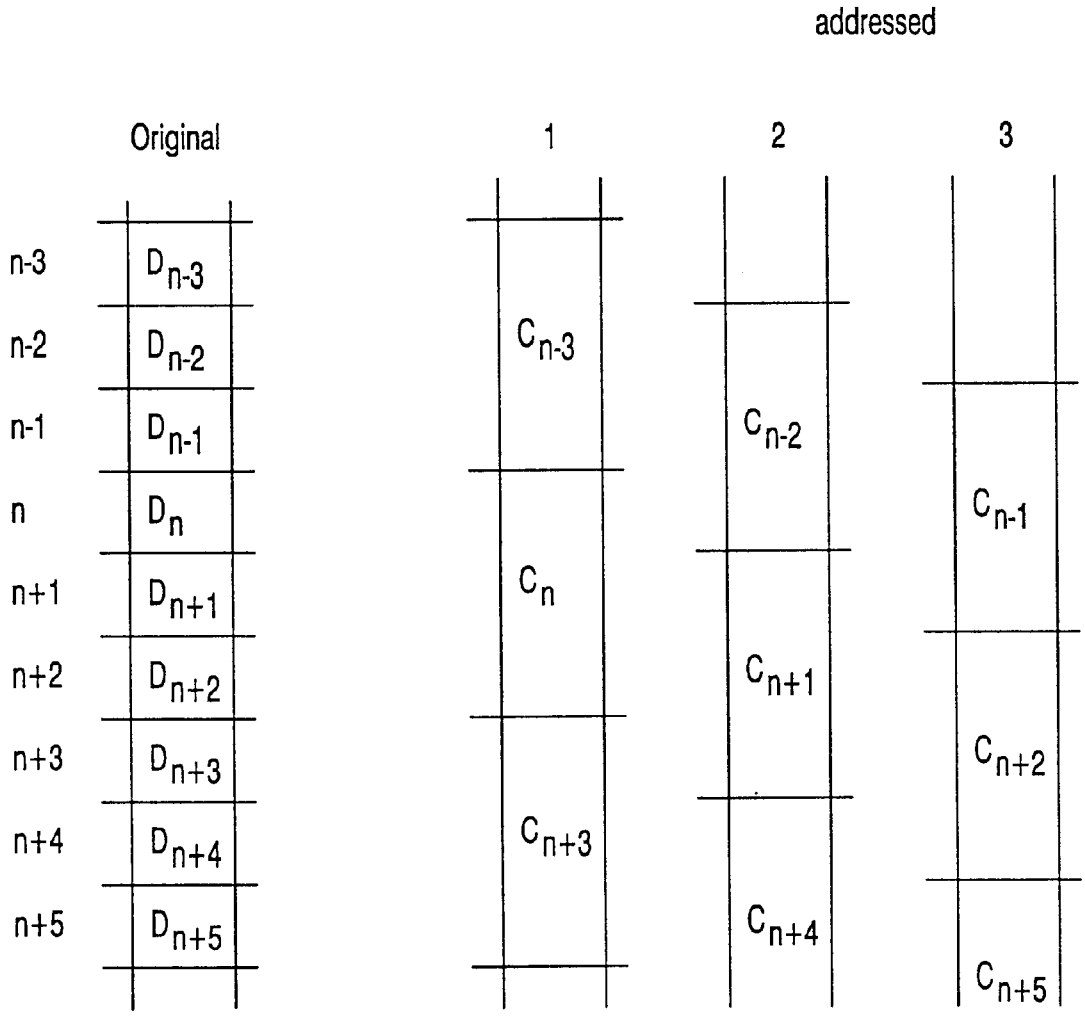
FIG. 3 schematically illustrates a triple line addressing method in accordance with the invention.

FIG. 3 illustrates a triple line addressing method.

The algorithm used (in accordance with equation (2a) is $$C_n = 3D_n - (C_{n-1} + C_{n-2}) \text{ (i.e. m=3)}$$

Two initial values are set, $C_{-1}$ and $C_0$, where preferably $C_0 = D_1$ and $C_{-1} = D_1$. This makes $C_1 = 3D_1 - (D_1 + D_1) = D_1$ Three consecutive frames denoted by 1, 2 and 3 in FIG. 3 are written. Note that the sequence could also be 1, 3, 2. The sequence in which the subframes are written may be chosen freely, although a sequential choice as illustrated in FIG. 3 is preferred. The average for line n is $$Average = (C_n + C_{n-1} + C_{n-2})/3 = (3D_n - (C_{n-1} + C_{n-2}) + (C_{n-1} + C_{n-2}))/3 = D_n$$

Thus, the average intensity for each line is correct (namely $D_n$) and the object of the invention is achieved.

In this embodiment of the invention, a triplet of lines of the set of lines (rows) is simultaneously addressed, receiving the same data. When two successive frames are considered, the triplets of lines in the second frame are shifted one line compared to the previous frame.

In the double line addressing method m (the multiplicity of the m-multiplets) is 2 and p (the shift) is 1, because there are two subframes and the shift between the subframes is one line. In the triple line addressing method shown in FIG. 3, m=3 and p is also one, because the index for the value $C_i$ is n in subframe 1, the index is n+1 in subframe 2 and the index of $C_i$ is n+2 in subframe 3.

If, using triple line addressing, the temporal sequence is not 1, 2, 3 as shown in FIG. 3, but 1, 3, 2, then the shift between the first and second sub-frame is two lines (i.e. p=2), and the C-index jumps by 2 (from $C_n$ to $C_{n+2}$) and the shift between the second and third subframe is −1 (i.e. the triplets shift one line back) as does the index of the values $C_i$ (from $C_{n+2}$ to $C_{n+1}$).

Because of the shift of the subframes, there will be incomplete multiplets at the top and/or at the bottom of the total image for some or all of the subframes. Some initial m−1 line luminance value data, $C_{1-(m-1)}$ to $C_0$ or a combination of these values may be supplied to these incomplete multiplets. In the double line addressing method, the value $C_0$ is supplied to the single first line in one of the subframes. In the double line addressing method and device as illustrated in FIG. 3, a value $C_{-1}$ would be supplied to a single line at the top of the image in one subframe and a value $C_0$ to a doublet at the top of the image in another subframe. The values which are supplied to these incomplete m-multiplets within the broadest concept of the invention (although it is preferred that said values correspond, or at least correspond substantially to the original value $D_1$) do not form a restriction for the scope of the invention. It is even possible that the first few lines (and/or the last few lines) are kept outside the visible range of the device. In this example, the numbering of the lines is done top-down, the numbering could also be done bottom-up.

In summary, the invention can be described as follows:

Matrix display devices are addressed, using a multiple line addressing method. In such a method, two or more paired lines are addressed at the same time and receive the same luminance value data. A method is provided where the line multiplet is shifted by a number of lines (preferably one) for two successive subframes, and where the average of the values over the subframes is equal to the original luminance value data.

Further improvements of the method comprise clipping of out-of-range values, and flicker reduction by limiting the differences between the luminance values for two successive frames.

While the invention has been described in connection with preferred embodiments, it will be understood that modifications thereof within the principles outlined above will be evident to those skilled in the art, and thus the invention is not limited to the preferred embodiments but is intended to encompass such modifications. It is possible to interchange rows and columns. The display lines may be arranged from the top down, or from the bottom up. The invention is applicable to display panels where the subfields mode is applied. The invention may be implemented by means of hardware comprising several distinct elements, and by means of a suitable programmed computer. The computing unit (3) may be a separate unit or integrated in a large unit, or formed by a computer or part of a computer comprising a suitable and executable program for performing the necessary calculations.

What is claimed is:

1. A matrix display device (1) comprising a receiving circuit for receiving successive frames (2), each frame comprising a set of original line luminance values $D_1, \ldots D_M$ of pixels $d_{11}, \ldots d_{1N}, \ldots d_{M1} \ldots d_{MN}$, the matrix display device (1) further comprising a display panel (5) comprising a set of display lines $r_1 \ldots r_M$, and a driver circuit (4) for supplying line luminance values to said display lines, characterized in that the matrix display device (1) comprises a computing unit (3) for computing new line luminance values $C_{1-(m-1)}, \ldots C_0, \ldots C_M$ of pixels $d_{11}, \ldots d_{1N}, \ldots d_{M1} \ldots d_{MN}$ on the basis of the original line luminance values $D_1, \ldots D_M$ as follows:

m−1 line luminance values $C_{1-(m-1)}, \ldots C_0$ are initialized, for every other one of the line luminance values $C_n$, the line luminance value $C_n$ is equal to m times the original line luminance value $D_n$ for the nth line minus the sum of the line luminance value for the m−1 previous lines $C_{n-1}$ to $C_{n-(m-1)}$ ($C_n = mD_n - \Sigma C_{n-i}$ (i=1 . . . (m−1)), the driver circuit comprises means for supplying the line luminance values $C_{1-(m-1)}, \ldots C_0, \ldots C_M$ to said display lines $r_1 \ldots r_M$ in m successive subframes, said subframes comprising a first subframe comprising line luminance values $C_1, C_{m+1}, \ldots C_{2m+1}, C_{3m+1}$ etc., a second subframe comprising line luminance values $C_{1-(m-1)}, C_2, C_{m+2}, C_{2m+2}$ etc., an m-th subframe comprising line luminance values $C_0, C_m, C_{2m}, C_{3m}$ etc., in each subframe addressing an m-multiplet of lines simultaneously with the same line luminance values $C_n$ and when two successive subframes are considered, the m-multiplet of lines in the later frame being shifted p lines compared to the previous subframe, and the index of the line luminance values $C_n$ being increased by p.

2. A matrix display device as claimed in claim 1, characterized in that the matrix display device (1) comprises a computing unit (3) for computing new line luminance values $C_0, \ldots C_M$ of pixels $d_{11}, \ldots d_{1N}, \ldots d_{M1} \ldots d_{MN}$ as follows:

a first line luminance value $C_0$ is initialized, for every other one of the line luminance values $C_n$, the line luminance value $C_n$ is equal to twice the original line luminance value $D_n$ for the nth line minus the line luminance value for the previous line $C_{n-1}$($C_n = 2D_n - C_{n-1}$), the driver circuit comprises means for supplying the computed luminance values data lines $C_0, \ldots C_M$ to said display lines $r_1 \ldots r_M$ in two successive subframes, odd line luminance values $C_1, C_3, \ldots C_{2n+1}, \ldots$ being supplied to pairs of adjacent display lines $(r_1,r_2)$, $(r_3,r_4), \ldots (r_{2n+1},r_{2n+2}), \ldots$ respectively, during one of said two successive subframes, the line luminance value $C_0$ and even line luminance values $C_2, C_4, \ldots C_{2n}, \ldots$ being supplied to the first display line $r_1$ and to pairs of adjacent display lines $(r_2,r_3), (r_4,r_5), \ldots (r_{2n},r_{2n+1}), \ldots$ respectively, during the other of said two successive subframes.

3. A matrix display device (1) as claimed in claim 1 or 2, characterized in that the computing unit (3) comprises a lower and an upper limit value, and in that said computing unit replaces all line luminance values smaller than said lower limit by said lower limit, and replaces all line luminance values larger than said upper limit by said upper limit.

4. A matrix display device (1) as claimed in claim 1, characterized in that the computing unit (3) comprises a threshold value Fth and performs, in the course of computing, for each successive line luminance value $C_n$, the steps of determining the absolute value of the computed luminance value $C_n$ minus the line luminance value $C_{n-1}$ ($abs(C_n - C_{n-1})$);

comparing said absolute value with said threshold value Fth;

if said absolute value is larger than said threshold value, determining the difference Δ of said absolute value minus said threshold value ($\Delta = abs(C_n - C_{n-1}) - Fth$);

and replacing $C_n$ by $C_n$ minus Δ if $C_n$ is larger than $C_n$, and replacing $C_n$ by $C_n$ plus Δ if $C_n$ is smaller than $C_n$.

5. A matrix display device (1) as claimed in claim 4, characterized in that the computing unit (3) comprises a threshold value Dth, compares said computed difference Δ with said threshold value Dth, and replaces said computed difference Δ by said threshold value Dth if said computed difference Δ is larger than said threshold value Dth in performing the last item of claim 4.

6. A matrix display device (1) as claimed in claim 1, characterized in that the computing unit (3) comprises a threshold Sth and performs, in the course of computing, for each successive line luminance value $C_n$, the steps of computing the absolute value of the line luminance value $C_n$ minus the original luminance value pixel $D_n$;

comparing said absolute value with said threshold Sth;

if said absolute value is smaller than said threshold Sth, replacing $C_n$ by $D_n$;

if said absolute value is larger than said threshold Sth, replacing $C_n$ by $C_n$ minus Sth if $C_n$ is larger than $D_n$, and replacing $C_n$ by $C_n$ plus Sth if $C_n$ is smaller than $D_n$.

7. A method of displaying successive frames, each frame comprising a set of original line luminance values $D_1, \ldots D_M$ for pixels $d_{11}, \ldots d_{1N}, \ldots d_{M1} \ldots d_{MN}$, on a display panel (1) comprising display lines $r_1, r_2 \ldots r_M$, extending in a first direction and data lines intersecting the display lines, each intersection defining a pixel, comprising the steps of computing line luminance values $C_{1-(m-1)}, \ldots C_0$, to $C_M$ on the basis of the original line luminance values $D_l, \ldots D_M$ as follows: initializing m−1 line luminance value $C_{1-(m-1)}$, $C_0$, for every other one of the line luminance values $C_n$, computing the line luminance value $C_n$ to be equal to m times the original line luminance value $D_n$ for the nth line minus the sum of the line luminance value of the m−1 previous lines $C_{n-1}$ to $C_{n-(m-1)}(C_n = mD_n - \Sigma C_{n-i}$ (i=1,(m−1)), and supplying the line luminance values $C_{1-(m-1)}, \ldots C_0, \ldots C_M$ to said display lines $r_1 \ldots r_M$ in m successive subframes, said subframes comprising a first subframe comprising line luminance values $C_1$, $C_{m+1}$, $C_{2m+1}$, $C_{3m+1}$ etc., a second subframe comprising line luminance values $C_{1-(m-1)}, C_2, C_{m+2}, C_{2m+1}$ etc., an m-th subframe comprising line luminance values $C_0, C_m$, $C_{2m}, C_{3m}$ etc., in each subframe addressing an m-multiplet of lines simultaneously with the same line luminance values $C_n$ and when two successive subframes are considered, the m-multiplet of lines in the later frame being shifted p lines compared to the previous subframe, and the index of the line luminance values $C_n$ being increased by p.

8. A method as claimed in claim 7, characterized in that the method comprises the steps of (a) initializing a first line luminance value $C_0$;

(b) for every other one of the line luminance values $C_n$, computing the line luminance value $C_n$ as twice the original line luminance value $D_n$ for the nth line minus the line luminance value for the previous line $C_{n-1}(C_n = 2D_n - C_{n-1})$;

(c) supplying the line luminance values $C_0, \ldots C_M$ to said display lines $r_1, \ldots r_M$ as two successive subframes, the odd line luminance values $C_1, C_3, \ldots C_{2n+1}, \ldots$ being supplied to pairs of adjacent display lines $(r_1, r_2)$, $(r_3, r_4), \ldots (r_{2n+1}, r_{2n+2}), \ldots$ respectively, during one of said two successive subframes, and the computed initial value data line $C_0$ and even line luminance values $C_2, C_4, \ldots C_{2n}, \ldots$ being supplied to the first display line $r_1$ and to pairs of adjacent display lines $(r_2, r_3)$, $(r_4, r_5), \ldots (r_{2n}, r_{2n+1}), \ldots$ respectively, during the other of said two successive subframes.

9. A method as claimed in claim 7, characterized in that after step (b), and before step (c) of claim 7 or 8, all line luminance values $C_n$ smaller than a lower limit are replaced by said lower limit, and all line luminance values $C_n$ larger than an upper limit are replaced by said upper limit.

10. A method as claimed in claim 7, characterized in that it comprises the steps of determining the absolute value of the line luminance value $C_n$ minus the line luminance value $C_{n-1}$ (abs($C_n - C_{n-1}$));

comparing said absolute value with said threshold value Fth;

if said absolute value is larger than said threshold value, determining the difference Δ of said absolute value minus said threshold value (Δ=abs($C_n - C_{n-1}$)−Fth);

and replacing $C_n$ by $C_n$ minus Δ if $C_n$ is larger than $C_n$, and replacing $C_n$ by $C_n$ plus Δ if $C_n$ is smaller than $C_n$.

11. A method as claimed in claim 10, characterized in that it comprises the steps of comparing said computed difference Δ with said threshold value Dth;

replacing said computed difference Δ by said threshold value Dth if said computed difference Δ is larger than said threshold value Dth in performing the last step of claim 10.

12. A method as claimed in claim 7, characterized in that it comprises the steps of computing the absolute value of the line luminance value $C_n$ minus the original line luminance value $D_n$;

comparing said absolute value with said threshold Sth;

if said absolute value is smaller than said threshold Sth, replacing $C_n$ by $D_n$;

if said absolute value is larger than said threshold Sth, replacing $C_n$ by $C_n$ minus Sth if $C_n$ is larger than $D_n$, and replacing $C_n$ by $C_n$ plus Sth if $C_n$ is smaller than $D_n$.

* * * * *